US007473085B2

(12) United States Patent
Schlecht

(10) Patent No.: US 7,473,085 B2
(45) Date of Patent: Jan. 6, 2009

(54) DRYWALL FINISHING TOOL

(75) Inventor: Werner Schlecht, Paradise Valley, AZ (US)

(73) Assignee: Cinta Tools LLC, Tempe, AZ (US)

( * ) Notice: Subject to any disclaimer, the term of this patent is extended or adjusted under 35 U.S.C. 154(b) by 98 days.

(21) Appl. No.: 11/453,455

(22) Filed: Jun. 14, 2006

(65) Prior Publication Data

US 2007/0292196 A1 Dec. 20, 2007

(51) Int. Cl.
*B28B 3/00* (2006.01)

(52) U.S. Cl. ..... 425/87; 425/458

(58) Field of Classification Search ..... 425/87, 425/458, 113, 131.1, 462; 401/5, 48, 171; 222/326, 386, 470; 92/89, 125; 141/26
See application file for complete search history.

(56) References Cited

U.S. PATENT DOCUMENTS

| | | | | | |
|---|---|---|---|---|---|
| 2,809,513 | A * | 10/1957 | Ames | 425/87 |
| 2,824,442 | A * | 2/1958 | Ames | 425/87 |
| 3,116,511 | A * | 1/1964 | Hoveland | 401/171 |
| 3,343,202 | A * | 9/1967 | Ames | 425/87 |
| 4,516,868 | A * | 5/1985 | Molnar | 401/5 |
| 4,767,297 | A | 8/1988 | Mower et al. | |
| 4,907,955 | A * | 3/1990 | Snipes | 425/87 |
| 5,882,691 | A | 3/1999 | Conboy | |
| 6,146,039 | A * | 11/2000 | Pool et al. | 401/48 |
| 6,581,805 | B2 | 6/2003 | Conboy et al. | |
| 2005/0100386 | A1 * | 5/2005 | Murray | 401/5 |
| 2007/0259064 | A1 * | 11/2007 | Mathews | 425/87 |

OTHER PUBLICATIONS

Co-pending U.S. Appl. No. 11/292,238, filed Nov. 30, 2005, inventor Werner Schlecht, entitled "Drywall Mud Pump."
Flat Finisher Box, schematic, available at http://www.bannertown.com/columbiatools.htm, May 9, 2000.
Flat Box and Easyclean Box, operation and maintenance guide, available at http://www.tapetech.com/tools.htm, Dec. 2003.

* cited by examiner

*Primary Examiner*—Philip C Tucker
*Assistant Examiner*—Dimple N Bodawala
(74) *Attorney, Agent, or Firm*—Bryan Cave LLP

(57) ABSTRACT

A drywall finisher's flat box is disclosed, having an adjustable pressure plate spring, independent suspension for guide wheels on the back plate, and a wiper configured so that the pressure plate can be pushed flat against the back plate, thus expelling nearly all of the drywall compound from the flat box.

19 Claims, 5 Drawing Sheets

DRYWALL FINISHING TOOL

BACKGROUND OF THE INVENTION

A "flat box" is a standard drywall finishing tool for applying drywall compound, also called "mud," to joints between sheets of drywall after taping the joints. Often the drywall compound is applied in three coats, called the base coat, finish coat and skim coat, using flat boxes of different sizes.

The device is the general shape of an approximately 30 degree partial cylinder. One flat side, the back plate, has a slot for expelling drywall compound. Side plates and a radius plate combine with the back plate to form an open box-like enclosure. Another flat side, called the pressure plate, completes the enclosure and is pivotably attached to the back plate so it may be pressed toward the back plate, squeezing out the drywall compound through the slot. A long handle attaches to the pressure plate so the operator may move the box along the wall and assert the pressure needed to squeeze out the compound. A flexible polymer wiper blade attached to the free end of the pressure plate provides a flexible seal that pushes the drywall compound out as the plates are pressed together.

A disadvantage of prior art flat box designs is that the edge of the wiper blade extends beyond the edge of the pressure plate, so in operation the pressure plate must be stopped short of flattening against the back plate in order to prevent damage to the wiper. Incorporation of a stop mechanism protects the wiper but leaves a volume of drywall compound inside the box when the operator stops to reload the box.

The current invention addresses this disadvantage by permitting the device to expel almost all its contents before reloading the box. Improvements shown in additional embodiments provide a variable spring tension applied to the pressure plate and independently suspended wheels for moving the box against the wall.

DETAILED DESCRIPTION OF THE INVENTION

Figure 1:
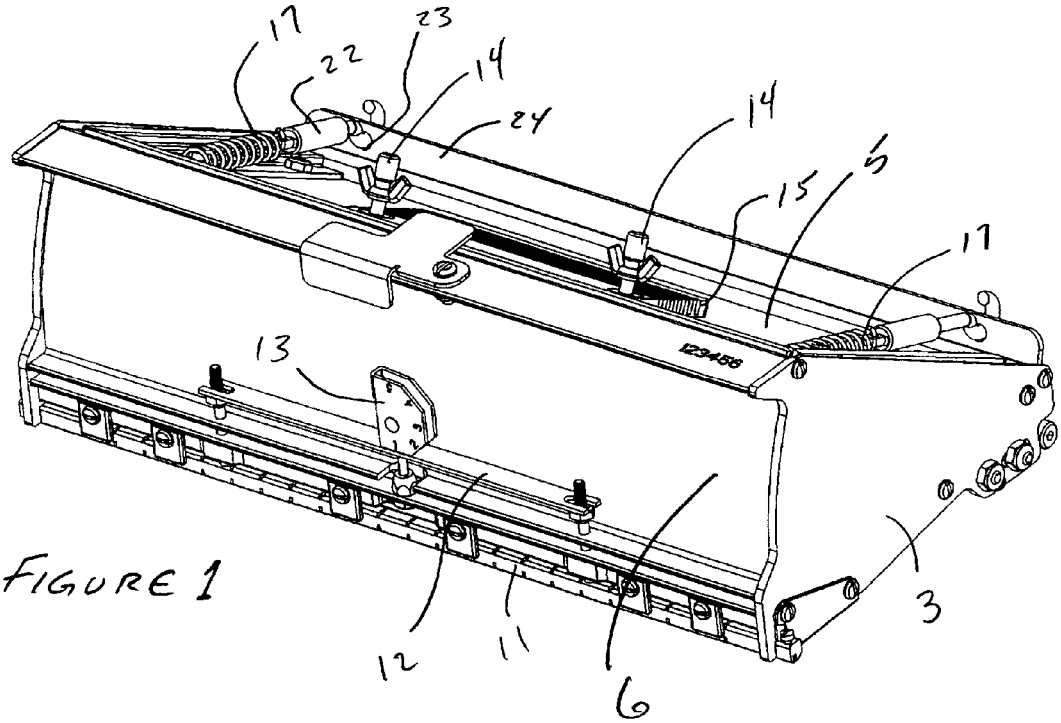
FIG. 1. is a perspective view of an embodiment of the current invention facing toward the radius plate.
Figure 2:
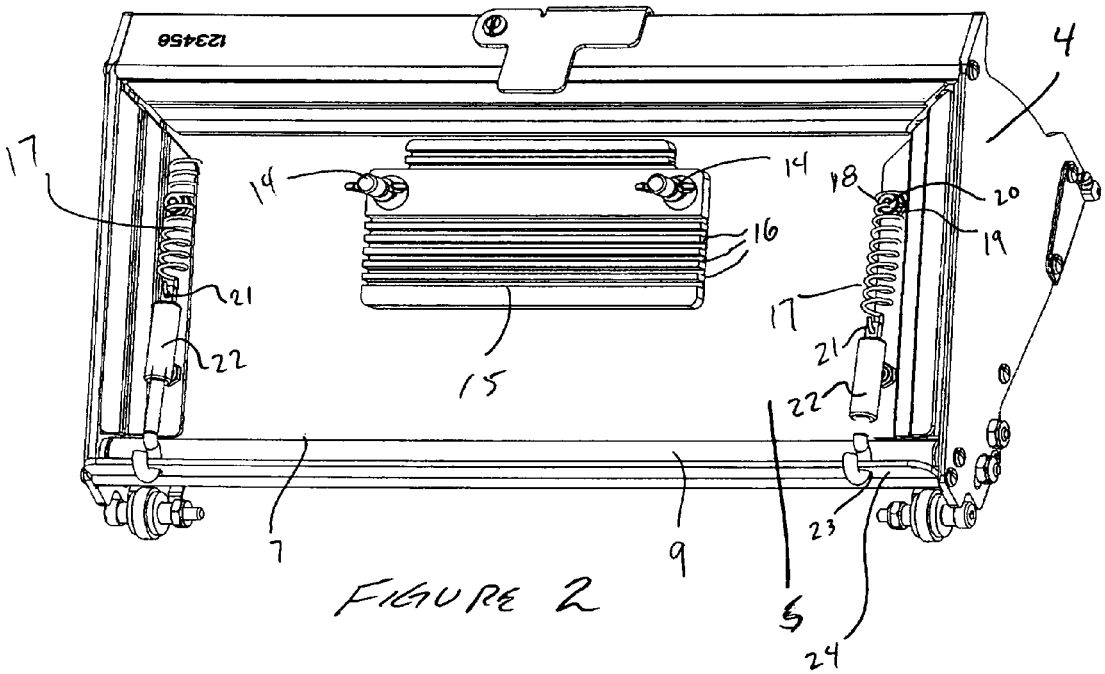
FIG. 2. is a view of the embodiment of FIG. 1 facing toward the pressure plate.
Figure 3:
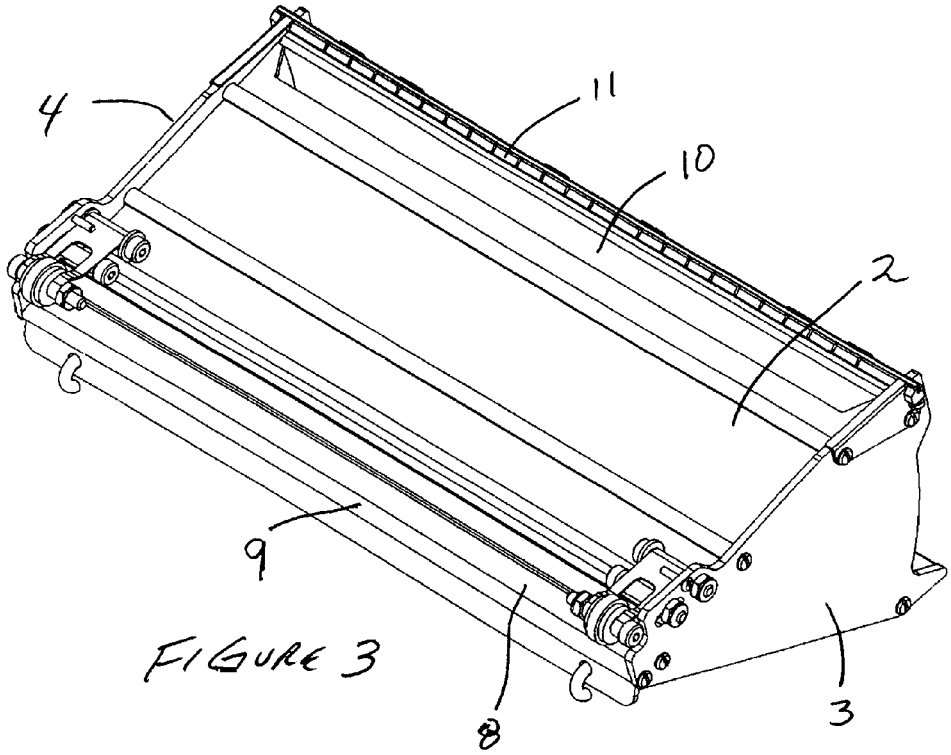
FIG. 3. is a view of embodiment of FIG. 1 facing toward the back plate.

FIGS. 1-3 show various perspectives of an embodiment of the present invention. The flat box comprises a back plate or pivot plate 2, left and right side plates 3 and 4, a pressure plate 5, and a radius plate 6. The pressure plate is pivotably attached at the pivot end 7 to the pivot end 8 of the back plate 2 with an axle assembly 9.

Back plate 2 includes a slot 10 for expulsion of drywall compound onto the wall. A trowling blade 11 is attached above slot 10 to distribute the drywall compound as it comes out of the unit. An adjustable crown spring 12 and dial 13, known in the art, are attached at radius plate 6 to adjust the arc of the trowling blade 11.

Pressure plate 5 is preferably an anodized aluminum rectangular plate fitted to the dimensions of the box. The pressure plate incorporates handle mounting screws 14 for attachment of a long handle (not shown).

In one embodiment, a pressure plate handle spacer 15, comprising a raised area of the plate 5 the size of a standard flat box handle mounting plate (not shown) is integrally manufactured with the pressure plate. To save weight, the handle spacer may have one or more channels 16, decreasing the amount of plate material but maintaining the structural strength needed to sustain the pressure applied by the operator.

The pressure plate 5 also incorporates one or more pressure plate springs 17. These springs 17 supply a counterforce that tends to pull the pressure plate 5 away from the back plate 2 when the operator is not exerting force against the pressure plate 5, so the drywall compound does not come out of the box while it is being moved to the next location. If the spring 17 pulls the pressure plate 5 all the way back, as the fixed springs of the prior art do, drywall compound falls back into the box and requires extra exertion to be pushed back to the slot 10. The springs 17 of one embodiment of the invention are adjustable. One end 18 of the spring 17 is held in place by a spring anchor nut 19 attached to a spring anchor bolt 20. The other end 21 of the spring 17, near the pivot axle 9, is attached to a turnbuckle-type spring tension adjuster 22 that attaches through an aperture 23 in an extension 24 of the back plate. Turning the barrel of the turnbuckle 22 permits the operator to set the tension on either or both springs 17. Optimally, the tension can be set so that the pressure plate 5 pulls back the minimum amount required to keep the mud from coming out of the box while the unit is moved. Other spring tension assemblies may be used for this function.

Figure 4:
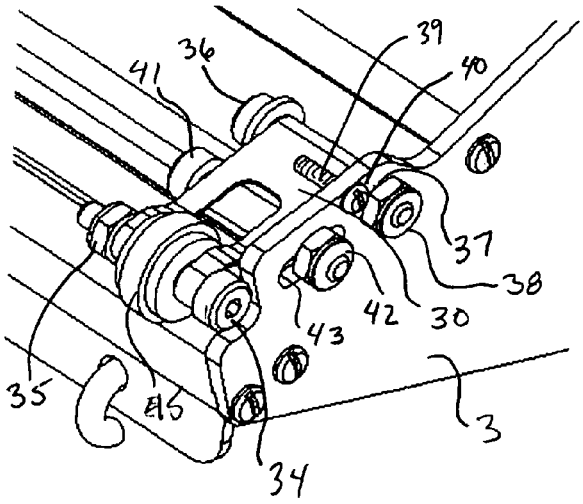
FIG. 4. is a close view of a wheel assembly in one embodiment of the invention.
Figure 5:
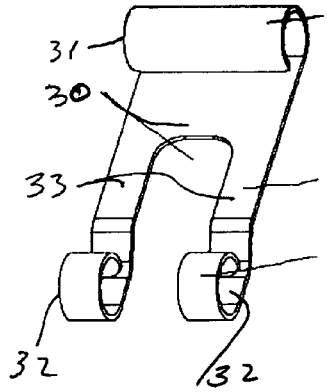
FIG. 5. is the wheel suspension spring in one embodiment of the invention.

In another embodiment, the flat box includes independently suspended wheels parallel to the back plate. For each wheel 45, as shown in FIGS. 4 and 5 suspension spring 30 is a stainless steel clip with a tubular channel 31 at one end and a pair of wheel mounting apertures 32 at the ends of flex legs 33. Shoulder bolt 34 passes through the wheel mounting apertures 32 and is secured by nut 35 to form an axle for wheel 45. Mounting shoulder bolt 36 passes through the tubular channel 31 and an aperture 37 in side plate 3 and is secured by nut 38, holding the spring in place. Retaining screw 39 threads through a small aperture 40 in the side plate 3, positioned so that the retaining screw 39 sits above the spring 30 and inhibits the spring 30 from flopping around. A tension adjuster bolt 41 with a lock nut 42 fits in slotted opening 43 in the side plate 3 and sits under the spring 30. The tension bolt 41 may be positioned toward the front of the flat box, whereby the wheel 45 is on a more flexible mount, or positioned toward the rear of the flat box, whereby a shorter length of the spring 30 is available, thus making the wheel 45 stiffer.

The wheels 45 decrease the friction as the flat box is dragged across the wall. With independent suspension, either of the wheels 45 can ride over a rough spot on the wall without disturbing the balance of the flat box or the position of the trowling blade against the wall.

As seen in FIGS. 6-10, a wiper 50, made of a flexible material such as polymer rubber substitute such as the nitrile copolymer known as Buna-N, or other materials known in the industry, is attached to the pressure plate 5 by inserting ridges 51 in the wiper into slot 53 in the pressure plate. The wiper prevents backward escape of drywall compound as the pressure plate is pushed toward the back plate, and cleans drywall compound off the interior surface of the radius plate, pushing it toward the slot. The leading edge 52 of wiper 50 does not extend beyond the interior surface 54 of pressure plate 5 into the enclosure formed by the surrounding plates. This configuration allows the pressure plate to be pushed flat against the back plate 2 without damaging the wiper 50, and permits expulsion of nearly all the drywall compound from the flat box.

Figure 6:
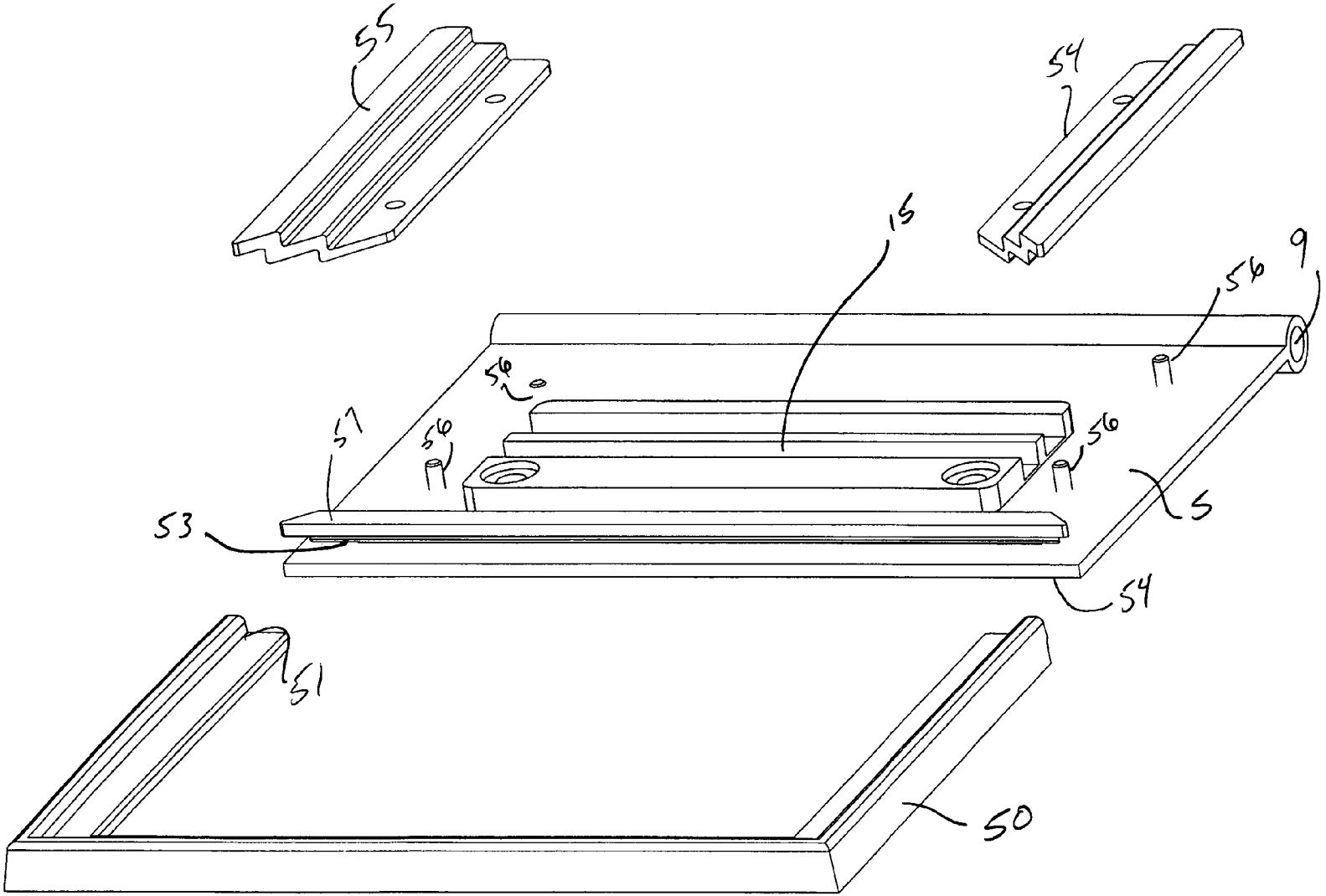
FIG. 6. is an exploded perspective view of the pressure plate and wiper assembly in one embodiment of the invention.
Figure 7:
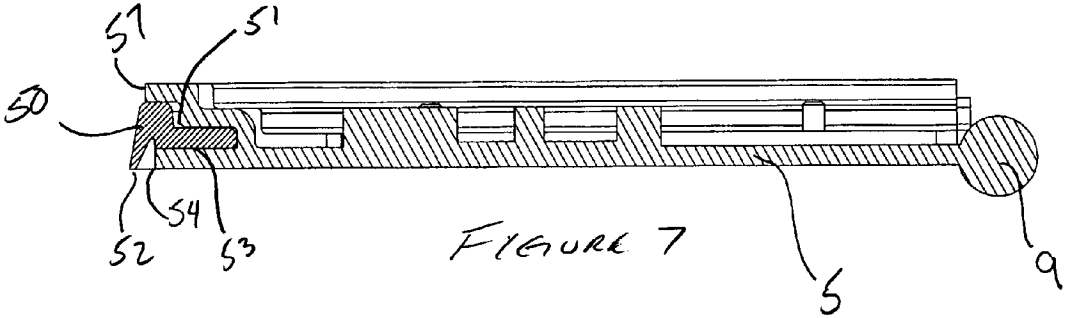
FIG. 7. is a cross section of the pressure plate of FIG. 6 with the wiper in place.
Figure 8:
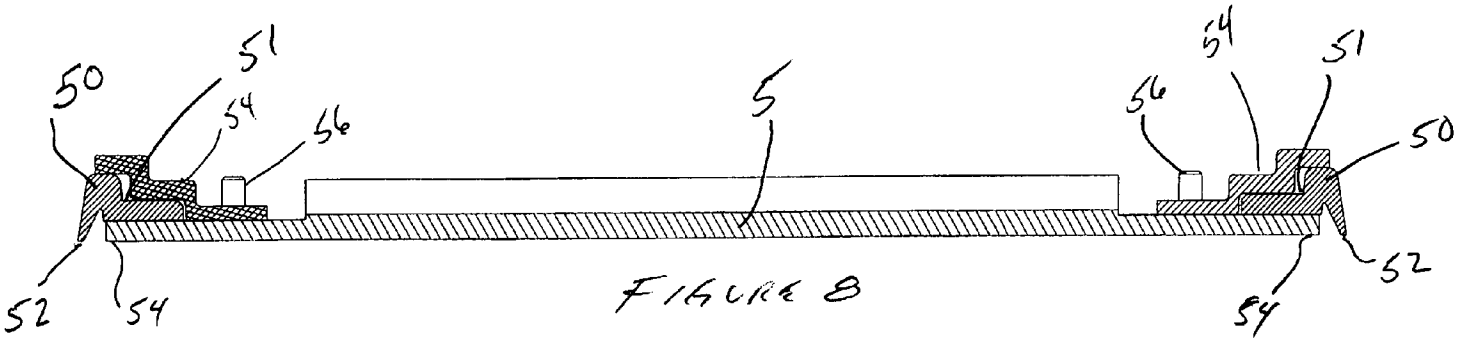
FIG. 8. is a transverse cross section of the pressure plate of FIG. 6 with the wiper in place.
Figure 9:
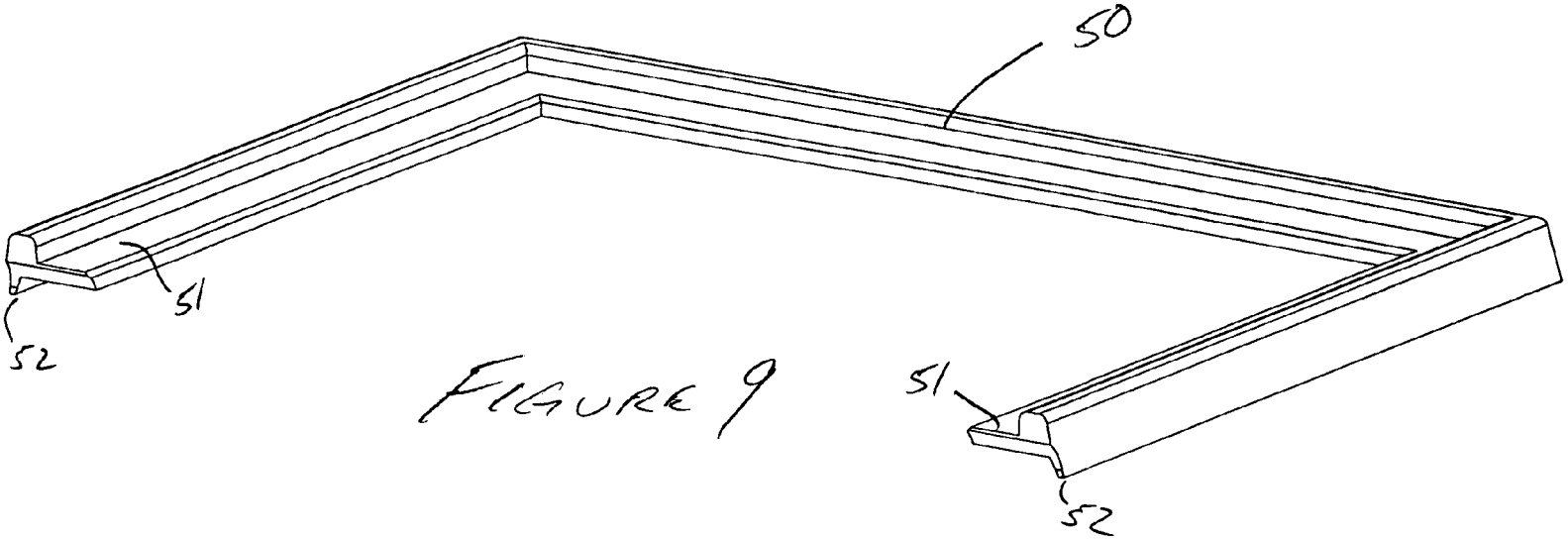
FIG. 9. is a perspective view of a wiper of the present invention.
Figure 10:
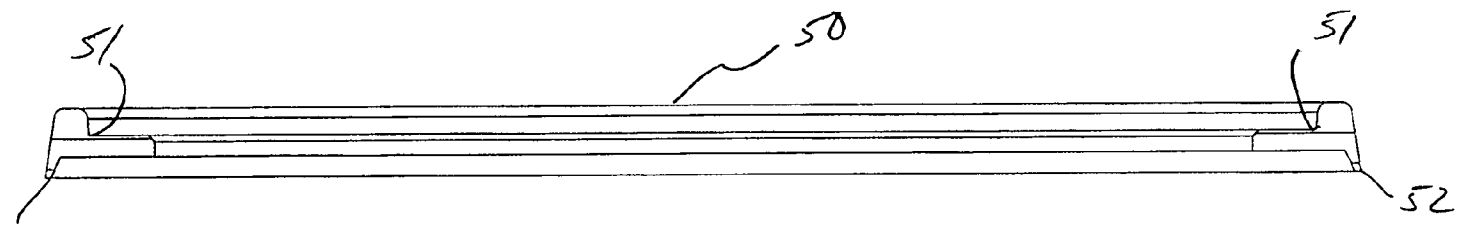
FIG. 10. is an end view of a wiper of the present invention.

As seen more particularly in FIGS. 6-8, wiper 50 fits into a recess or slot 53 created by a raised extension 57 across the width of the pressure plate 5. Left and right wiper retainers, 54, 55, are clamped over the wiper 50 and held to the pressure plate with nuts and bolts 56. Wiper edge 52 extends peripherally beyond pressure plate 5 just enough to create a seal with the side plates 3,4 and the radius plate 6 sufficient to keep the drywall compound beneath the pressure plate as the pressure plate moves against the back plate, squeezing compound out through the exit slot 10.

Although the invention has been described with respect to specific embodiments, persons of ordinary skill in the art will readily understand that the inventive concepts may be applied to a variety of configurations including, without limitation, variations in the adjustable pressure spring assemblies or the independent wheel suspensions.

I claim:

1. A drywall finisher's flat box comprising an enclosure defined by a back plate, a pressure plate, a radius plate and opposing side plates, wherein a wiper is affixed to the pressure plate so that the wiper does not extend past the pressure plate into the enclosure.

2. The flat box of claim 1 wherein the pressure plate includes a raised area with slots to retain a portion of the wiper and a plurality of wiper retainers are attached to the pressure plate to retain remaining portions of the wiper.

3. The flat box of claim 1 further including at least one tension adjustable pressure plate spring.

4. The flat box of claim 3 wherein the spring is attached at one end to the pressure plate and at the other end to a turnbuckle tension adjuster that is attached to the back plate.

5. The flat box of claim 2 further including a plurality of independently suspended exterior wheels.

6. The flat box of claim 3 further including a plurality of independently suspended exterior wheels.

7. A drywall finisher's flat box comprising an enclosure defined by a back plate, a pressure plate, a radius plate, and opposing side plates, wherein the flat box further comprises at least one of:

a wiper affixed to the pressure plate so that the wiper does not extend past the pressure plate into the enclosure; and a pressure plate spring with a spring tension adjuster.

8. The flat box of claim 7 comprising the pressure plate spring and the spring tension adjuster.

9. The flat box of claim 8 wherein the spring is attached to a turnbuckle tension adjuster and at least one of the spring and turnbuckle tension adjuster is attached to the pressure plate.

10. The flat box of claim 7 further comprising a plurality of independently suspended exterior wheels including a suspension spring.

11. The flat box of claim 10 comprising the pressure plate spring and the spring tension adjuster.

12. A drywall finisher's flat box comprising an enclosure in the shape of a partial cylinder, wherein the enclosure is defined by a back plate comprising a slot for expelling drywall compound, a pivotably attached pressure plate, a radius plate, and opposing side plates, wherein the flat box further comprises at least one of:

a wiper affixed to the pressure plate, wherein the wiper fits into a slot created by a raised extension across a width of the pressure plate, and wherein the wiper does not extend past the pressure plate into the enclosure, thus allowing the pressure plate to move against the back plate allowing more drywall compound to be expelled from the flat box before reloading the flat box with drywall compound; and a pressure plate spring positioned and configured to supply a counterforce that tends to pull the pressure plate away from the back plate when an operator is not exerting force against the pressure plate so that the drywall compound does not come out of the flat box while the flat box is being moved to a next location, and a spring tension adjuster that permits an operator to set tension of the pressure plate spring.

13. The flat box of claim 12 further comprising a trowling blade attached by the slot, wherein the trowling blade distributes the drywall compound as the drywall compound comes out of the slot.

14. The flat box of claim 12 comprising the pressure plate spring and the spring tension adjuster that permits an operator to set tension of the pressure plate spring.

15. The flat box of claim 14 wherein the spring tension adjuster comprises a turnbuckle-type spring tension adjuster.

16. The flat box of claim 12 further comprising a plurality of exterior wheels having suspension comprising at least one suspension spring, wherein the wheels are positioned and configured to decrease friction as the flat box is moved across a wall.

17. The flat box of claim 16 comprising the pressure plate spring and the spring tension adjuster that permits an operator to set tension of the pressure plate spring.

18. The flat box of claim 17 comprising the wiper affixed to the pressure plate, wherein the wiper fits into the slot created by the raised extension across the width of the pressure plate, and wherein the wiper does not extend past the pressure plate into the enclosure.

19. The flat box of claim 12 comprising the wiper affixed to the pressure plate, wherein the wiper fits into the slot created by the raised extension across the width of the pressure plate, and wherein the wiper does not extend past the pressure plate into the enclosure.

* * * * *